US009682401B2

(12) United States Patent
Kotnik et al.

(10) Patent No.: US 9,682,401 B2
(45) Date of Patent: Jun. 20, 2017

(54) COATING APPLICATION

(71) Applicant: Lockheed Martin Corporation, Bethesda, MD (US)

(72) Inventors: R. Barrett Kotnik, Smyrna, GA (US); Dustin Loden, Austell, GA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 677 days.

(21) Appl. No.: 13/832,329

(22) Filed: Mar. 15, 2013

(65) Prior Publication Data

US 2014/0261081 A1 Sep. 18, 2014

(51) Int. Cl.

| | |
|---|---|
| ***B05C 3/02*** | (2006.01) |
| ***B05D 1/30*** | (2006.01) |
| ***B05C 5/02*** | (2006.01) |

(52) U.S. Cl.

CPC ..... *B05D 1/30* (2013.01); *B05C 5/0204* (2013.01); *B05C 5/0216* (2013.01)

(58) Field of Classification Search

USPC ..... 118/401, 402, 407, 410, 412; 427/430.1; 401/265

See application file for complete search history.

(56) References Cited

U.S. PATENT DOCUMENTS

| | | | | |
|---|---|---|---|---|
| 1,158,460 A | | 11/1915 | Doll | |
| 2,108,952 A | | 7/1937 | Urban | |
| 2,643,408 A | | 1/1950 | Decker | |
| 4,006,049 A | * | 2/1977 | Gardner | B05C 1/14 156/195 |
| 4,451,164 A | * | 5/1984 | Roberts, Jr. | A47L 13/17 400/274 |
| 4,518,634 A | | 5/1985 | Gini et al. | |
| 4,943,451 A | * | 7/1990 | Zimmer | 427/294 |
| 5,277,511 A | | 1/1994 | Stockton | |
| 5,489,046 A | * | 2/1996 | Wickham | B65D 83/00 222/184 |
| 6,120,603 A | | 9/2000 | Bryant | |

FOREIGN PATENT DOCUMENTS

| | | |
|---|---|---|
| GB | 602084 A | 5/1948 |
| GB | 2047127 A | 11/1980 |

OTHER PUBLICATIONS

European Search Report dated Jul. 14, 2014 for Application No. 14159559.5-1760; Applicant: Lockheed Martin Corporation; 7 pages.

* cited by examiner

*Primary Examiner* — Yewebdar Tadesse

(74) *Attorney, Agent, or Firm* — Reising Ethington P.C.

(57) ABSTRACT

A method of, and an applicator for, applying a bead of a liquid coating material to a work surface by configuring a reservoir of a liquid coating applicator for viscous retention of the liquid coating material to be applied, and further configuring the reservoir to dispense the liquid coating material via surface adhesion, cohesion, and gravity.

14 Claims, 4 Drawing Sheets

COATING APPLICATION

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND

Field

The present disclosure relates generally to coating and, more particularly, to coating methods and products used to apply coatings to work surfaces.

Description of the Related Art Including Information Disclosed Under 37 CFR 1.97 and 1.98

Manufacturing processes in many fields require extremely precise and consistent coatings, for instance, uniformly thick beads of material. For example, aircraft wing panels often require application of ribbon-shaped sealant beads. It is known to apply such beads by squirting sealant from a tube onto a work surface and then using a roller to smooth out the sealant to a desired thickness. But current bead application techniques may be too messy, may vary in quality significantly from worker to worker, may take too much time to accomplish, and wastes much costly material.

SUMMARY

In one embodiment, a coating applicator includes a liquid coating material reservoir configured to retain a liquid coating material via viscous retention and to dispense a liquid coating bead via surface adhesion, cohesion, and gravity.

In another embodiment, there is presented a method of applying a bead of a liquid coating material to a work surface including:

- selecting a liquid coating material to be applied;
- configuring a reservoir of a liquid coating applicator for viscous retention of the liquid coating material;
- further configuring the reservoir to dispense the liquid coating material via surface adhesion, cohesion, and gravity;
- containing the liquid coating material in the applicator;
- supporting the applicator on a work surface such that the liquid coating material flows toward the work surface under its own weight due to gravity through a lower opening of the applicator and couples to the work surface according to adhesive forces between the liquid coating material and the work surface; and
- moving the applicator relative to the work surface so that a rear outlet of the applicator trails along a work path and so that the liquid coating material is pulled out of the applicator through the rear outlet according to cohesive forces of the liquid coating material.

DRAWINGS DESCRIPTION

These and other features and advantages will become apparent to those skilled in the art in connection with the following detailed description and drawings of one or more embodiments of the invention, in which.

DETAILED DESCRIPTION

Figure 1:
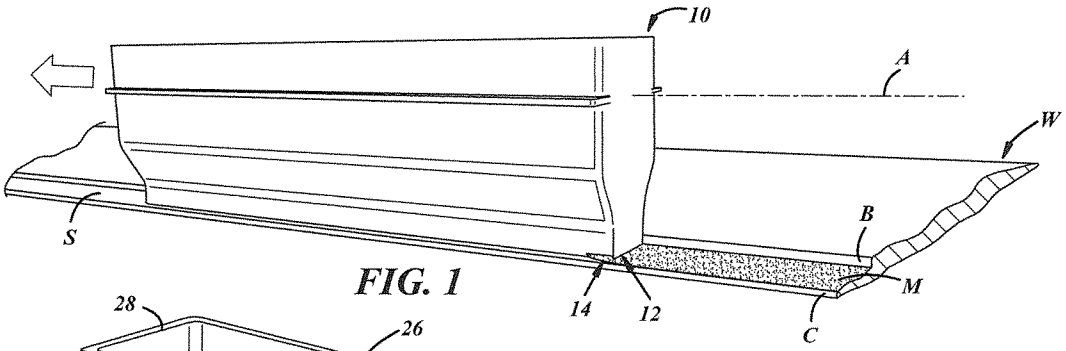
FIG. 1 is a fragmentary orthogonal view of an example embodiment of a coating applicator being used to apply material on a work surface of a work piece.

FIG. 1 illustrates an illustrative embodiment of a coating applicator 10 that may be used to apply a coating of material M to a work surface S of a work piece W. The applicator 10 may establish a reservoir that is configured to retain a liquid coating material via viscous retention and to dispense a bead of the liquid coating material via surface adhesion, cohesion, and gravity. For example, the applicator 10 may be a sealant applicator to apply a chromated sealant to a trailing edge of an aircraft wing. The sealant may be an adhesive sealant that tends to adhere to the work surface S according to adhesive forces that are stronger than adhesive forces between the sealant and the applicator 10. The applicator 10 may include a rear outlet 12 through which the material M may flow. The applicator 10 also may include one or more lateral outlets 14 upstream of the rear outlet 12 to facilitate creation of a desired width of a bead of the material M. The applicator 10 may be moved along a longitudinal axis A, and/or the work piece W may be moved along the axis A. In any event, the material M couples to the work surface S according to adhesive forces therebetween, flows under its own weight due to gravity, and is pulled out of the applicator 10 during relative motion between the applicator 10 and the work piece W according to cohesive forces of or within the material M itself.

The example embodiment is described and illustrated with reference to its use for applying an adhesive sealant in an aircraft wing environment. However, it will be appreciated as the description proceeds that the present disclosure is useful in many different applications and may be implemented in many other embodiments. In this regard, and as used herein and in the claims, it will be understood that the term "work surface" refers not only to aircraft wing applications, but also to aircraft fuselages, automobile bodies, watercraft hulls, windmill impellers, and any other suitable applications, and regardless of the particular type of material applied to the work surface. Also, as used herein and in the claims, the term "material" may include sealant, paste, resin, oil, paint, or any other moderate to high viscosity fluid, for example, 500 to 15,000 poise @~50 degrees F. and, more particularly, for instance, 1,000 to 4,000 poise @~50 degrees F.

Figure 2:
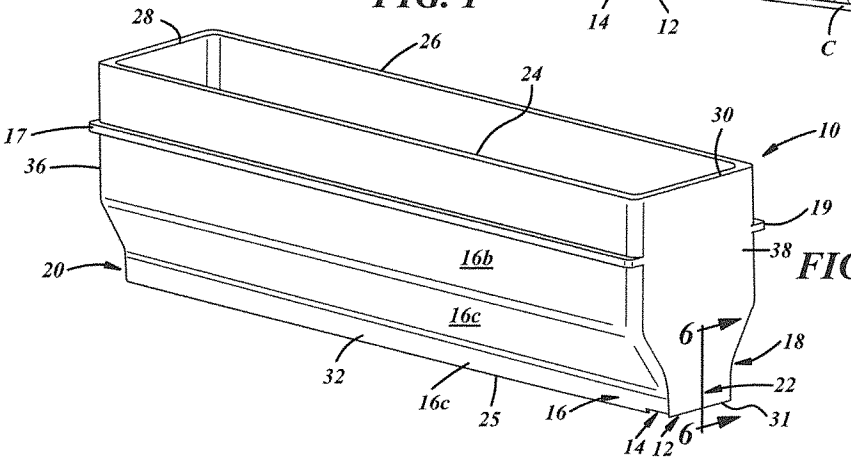
FIG. 2 is a top rear orthogonal view of the coating applicator of FIG. 1.
Figure 3:
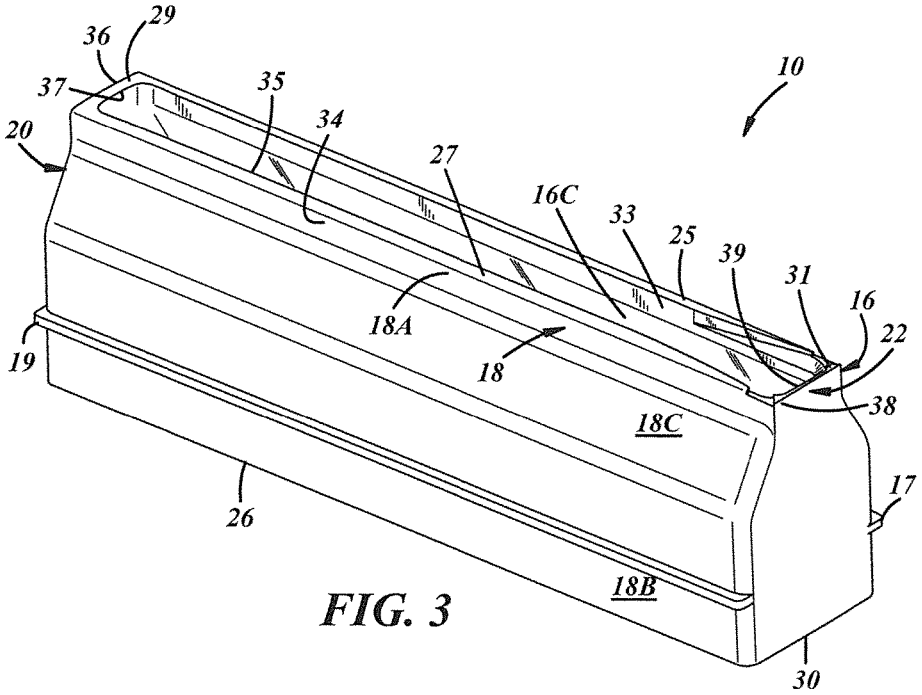
FIG. 3 is a bottom rear orthogonal view of the coating applicator of FIG. 1.

With reference to FIGS. 2 and 3, the applicator 10 includes side walls 16, 18 spaced laterally apart from one another, a front wall 20 coupled to and extending laterally between the side walls 16, 18, a rear wall 22 spaced apart longitudinally from the front wall 20 and coupled to and extending laterally between the side walls 16, 18. The front and rear walls 20, 22 may be straight, and the side walls 16, 18 may be offset, for example, to include lower portions 16*a*, 18*a*, upper portions 16*b*, 18*b*, and outwardly tapered portions 16*c*, 18*c* therebetween. Also, the sidewalls 16, 18 may include laterally outwardly extending flanges 17, 19, for example, to facilitate applicator handling, storage, or the like. The walls 16, 18, 20, 22 of the applicator 10 may be integral with one another.

In fact, the applicator 10 may be an integral, unitary, article of manufacture and may be produced by injection molding, additive manufacturing techniques, for instance, three-dimensional printing or stereo lithography, or in any other suitable manner. The applicator 10 may be composed of plastic, for example, acrylonitrile butadiene styrene (ABS). But those of ordinary skill in the art will recognize that the applicator 10 may be composed of metal constructed by welding, stamping, drawing, or the like, or may be composed of any other suitable material and constructed in any other suitable manner.

In any case, the walls 16, 18, 20, 22 include corresponding top surfaces 24, 26, 28, 30 (FIG. 2) and bottom surfaces 25, 27, 29, 31 (FIG. 3). The top surfaces 24, 26, 28, 30 may be coplanar and may establish an open top or inlet of the applicator 10. The bottom surfaces 25, 27, 29 of the side and front walls 16, 18, 20 may be coplanar, and all bottom surfaces 25, 27, 29, 31 may establish a bottom opening of the applicator 10. The bottom opening may be in a first opening plane.

Figure 4:
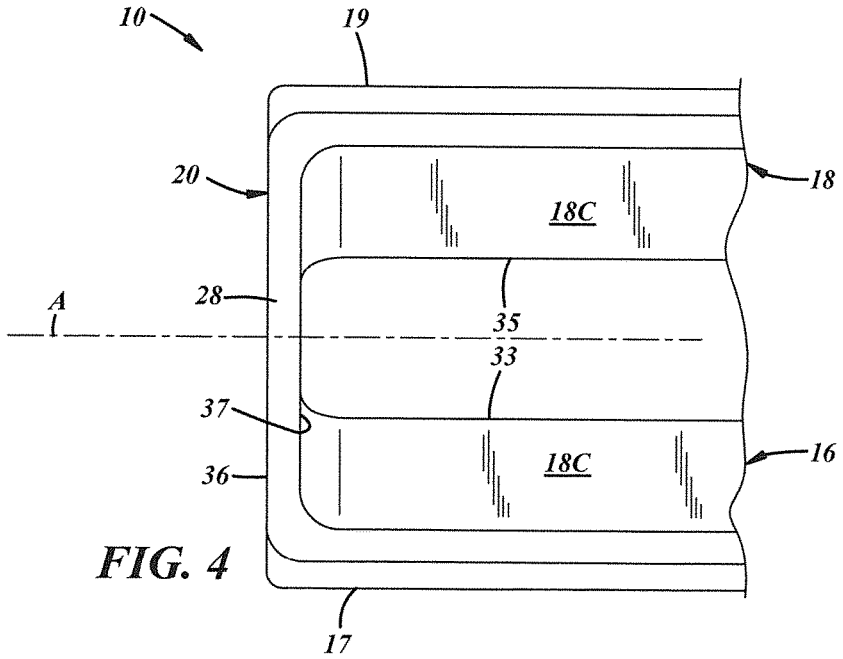
FIG. 4 is an enlarged, fragmentary, top view of a front portion of the coating applicator of FIG. 1.

Moreover, and referring now to FIGS. 4 and/or 5, the walls 16, 18, 20, 22 include corresponding exterior surfaces 32, 34, 36, 38, and correspondingly spaced apart interior surfaces 33, 35, 37, 39. The interior surfaces 33, 35, 37, 39 may contact the coating material, such that the walls 16, 18, 20, 22 establish a circumferentially complete reservoir to hold the coating material on the work surface for dispensing out of the rear outlet 12.

Figure 5:
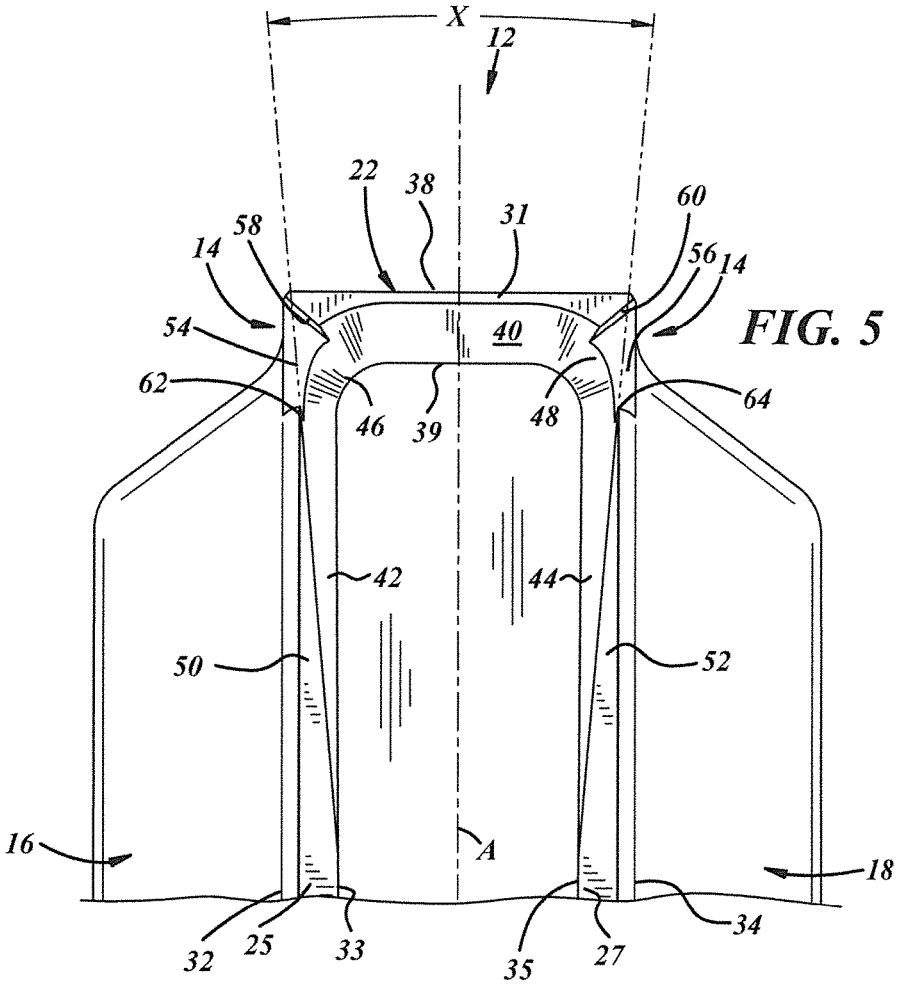
FIG. 5 is an enlarged, fragmentary, bottom view of a rear portion of the coating applicator of FIG. 1.
Figure 6:
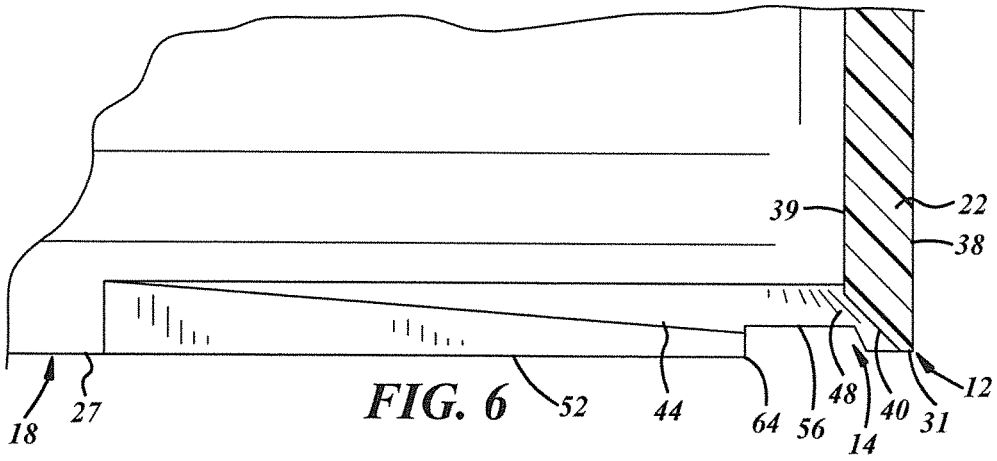
FIG. 6 is an enlarged, fragmentary, cross-sectional view of a rear portion of the coating applicator of FIG. 1, taken along line 6-6 of FIG. 2.

Referring to FIG. 5, the rear bottom surface 31 of the rear wall 18 extends from the rear exterior surface 38 and, more specifically, extends longitudinally between the rear exterior and interior surfaces 38, 39. As also shown in FIG. 6, the rear bottom surface 31 is spaced vertically or altitudinally away from the side bottom surfaces 25, 27 to establish the rear outlet 12. The rear bottom surface 31 may appear to be planar, as illustrated, or a narrow edge or line. The rear outlet 12 may be in communication with the bottom opening established by the front and/or side walls 16, 18, 20, and may be in a second opening plane disposed at a non-zero angle with respect to the first opening plane. For example, the second opening plane may be perpendicular to the first opening plane as illustrated, but may be disposed at any other suitable angle.

Still referring to FIG. 5, a rear bevel surface 40 extends from the rear bottom surface 31 in an inward direction and, more specifically, extends longitudinally and vertically between the rear bottom and interior surfaces 31, 39 to promote gradual compression of coating material toward the rear outlet 12. Accordingly, the coating material will be squeezed, instead of just sheared, before it exits the applicator 10 underneath the rear bottom surface 31. It was discovered that such material compression prior to exit results in good uniformity of bead thickness. Without the rear bevel surface 40, the applicator 10 tends to lay down a bead of coating material of unpredictable or non-uniform thickness.

Similarly, side bevel surfaces 42, 44 extend from side bottom surfaces 25, 27 in an inward direction and, more specifically, extend laterally and vertically between the side bottom and interior surfaces 25, 27, 33, 35 to further promote gradual squeezing of the coating material. The rear and side bevel surfaces 40, 42, 44 may be part of a continuous bevel surface that may extend greater than ninety angular degrees among the side and rear walls 16, 18, 22. For example, as shown, the continuous bevel surface (40, 42, 44) extends over about 270 angular degrees (among the rear wall 22 and the adjacent side walls 16, 18). The rear and side bevel surfaces 40, 42, 44 may be filleted and, as such, may include fillets 46, 48. The bevel surfaces 40, 42, 44 may be flat, dished or incurvate, or of any other suitable shape.

Also, the bottom surfaces 25, 27 of the side walls 16, 18 are longitudinally tapered to include tapered bottom surfaces 50, 52 that are wider in locations relatively distal with respect to the rear wall 22 and narrower in locations relatively proximate with respect to the rear wall 22. The tapered bottom surfaces 50, 52 establish an open taper angle X of, for example, between 5 and 15 degrees, including all sub-ranges of angles and discrete angles therebetween. More particularly, the open taper angle X may be between 8 and 9 degrees, including all sub-ranges of angles and discrete angles therebetween.

The lateral outlets 14 may be provided at least in portions of the side and rear walls 16, 18, 22 and may be in communication with the bottom opening. The lateral outlets 14 may include lateral outlet bottom surfaces 54, 56, which may extend laterally between the side exterior surfaces 32, 34 and the rear and side bevel surfaces 40, 42, 44. The lateral outlets 14 include forward facing surfaces 58, 60 in the rear wall 22 extending from the rear bottom surface 31 to the lateral outlet bottom surfaces 54, 56 and that may be disposed at a non-zero angle with respect to the longitudinal axis A of the coating applicator 10. The lateral outlets 14 also may include rearward facing surfaces 62, 64 that may extend vertically from the lateral outlet bottom surfaces 54, 56. The lateral outlets may be disposed in lateral opening planes different from the other opening planes of the bottom opening and the rear outlet 12, for example, at non-zero angles with respect to the first and second opening planes. For example, the lateral opening planes may be parallel to one another and perpendicular to the first and second opening planes as illustrated, but may be disposed at any other suitable angle(s).

Figure 7:
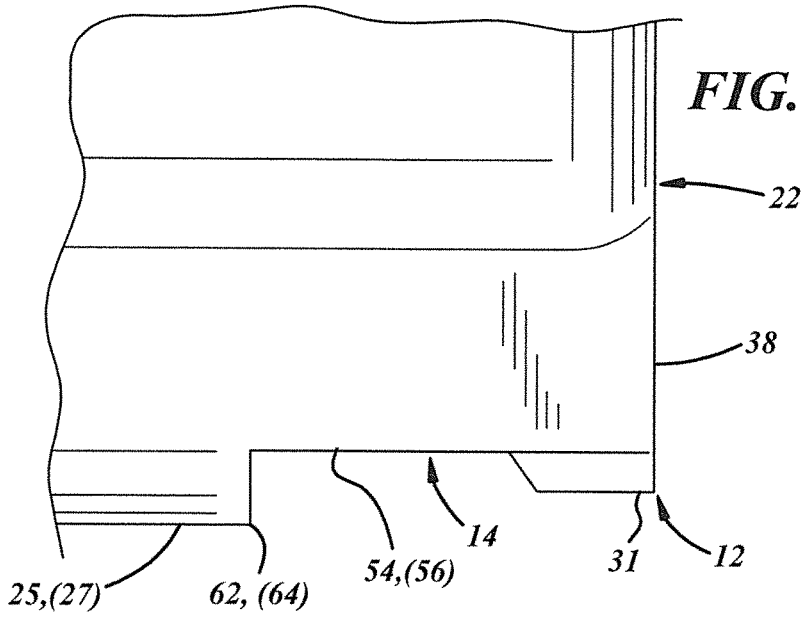
FIG. 7 is an enlarged, fragmentary, side view of a rear portion of the coating applicator of FIG. 1.
Figure 8:
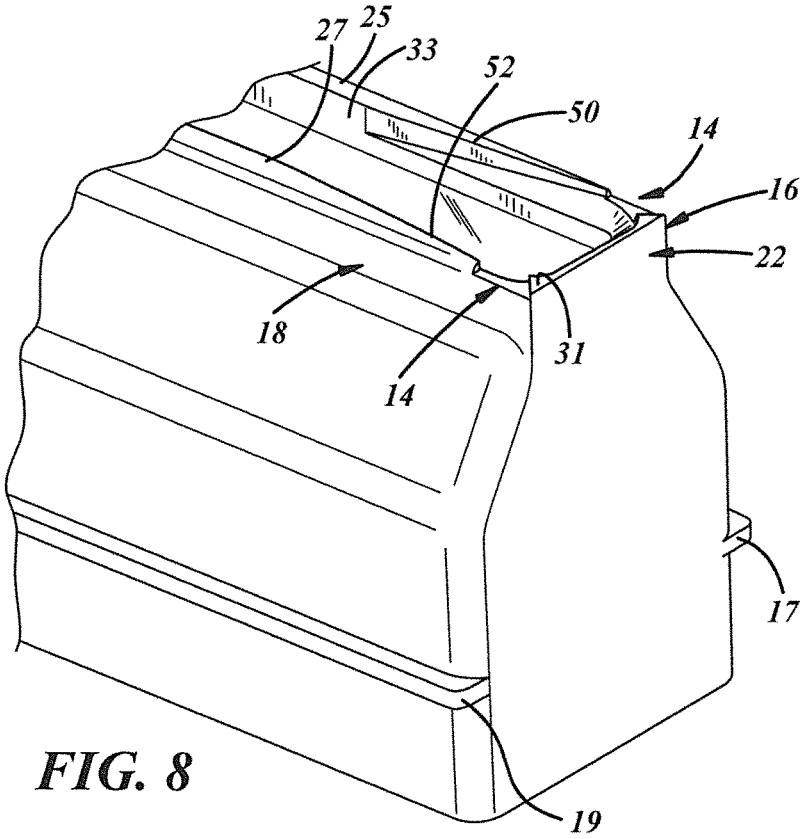
FIG. 8 is an enlarged, fragmentary, bottom rear orthogonal view of the coating applicator of FIG. 1.

With reference to FIGS. 6 and 7, the lateral outlet bottom surfaces 54, 56 may be spaced vertically from the rear bottom surface 31 in a direction away from the side bottom surfaces 25, 27.

With reference to FIGS. 1 and 2, the illustrated example applicator 10 may include the following dimensions and specifications. The overall length of the applicator 10 may be 7.75 inches, the overall height of the applicator 10 may be 2.375 inches, and the overall width of the applicator 10 not including the flanges 17, 19 may be 1.72 inches. The width of the applicator 10 at the lower portions 16*a*, 18*a* of the sidewalls 16, 18 may be 0.87 inches, the thickness of the walls 16, 18, 20, 22 may be 0.125 inches, and, thus, an example width of a bead of the coating material may be about 0.62 inches. The length of the outlet features may be 1.50 inches, from the wide portion of the tapered bottom surfaces 50, 52 to the exterior surface 38 of the rear wall 22. The space between the bottom surface 31 of the rear wall 22 and the bottom surfaces 25, 27 of the side walls may be 0.032 inches, and the space between the bottom surfaces 54, 56 of the lateral outlets 14 and the bottom surfaces 25, 27 of the side walls 16, 18 may be 0.062 inches. The thickness of the bead of material M may be, for example, 0.007" to 0.045" on the work surface S. The viscosity of the example chromated sealant was about 1825 poise @~50 degrees F., but any other suitable viscosity material may be used. Those of ordinary skill in the art will recognize that any other suitable dimensions and specifications may be used for an applicator according to the present disclosure, and that, in particular, the dimensions of the outlet features are application specific and dependent on material viscosity, desired coating thickness, and any other suitable factors.

In the illustrated embodiment, there is no bottom wall that connects the side walls 16, 18 and no wall that extends longitudinally from the rear wall 22 and laterally between the side walls 16, 18 over the rear outlet 12. Rather, the applicator 10 may be an open container from top to bottom with no obstructions therebetween. It is noted that the tapered portions 16*c*, 18*c* of the sidewalls 16, 18 are not obstructions.

According to another embodiment, there is presented a method of configuring a reservoir of a liquid coating applicator for viscous retention of a liquid coating material to be applied, and further configuring the reservoir to dispense the liquid coating material via surface adhesion, cohesion, and gravity. In other words, according to this method, the reservoir is configured to retain the liquid coating material via viscous retention before the applicator has been placed on a work surface, and to dispense the liquid coating material via surface adhesion, cohesion, and gravity when the applicator is supported on and being drawn across a work surface. The method further may include the following steps. Material may be contained in an applicator with a rear outlet so that the material flows toward the work surface under its own weight due to gravity and couples to the work surface according to adhesive forces between the material and the work surface. The applicator may be moved relative to the work surface so that the rear outlet trails along a work path and so that the material is pulled out of the applicator through the rear outlet according to cohesive forces of the material. Gradual compression of the material may be promoted in a vertical direction as the material is pulled from the applicator to the work surface through the outlet.

The method also may include configuring the reservoir to promote gradual expansion of the material in a lateral direction as it is pulled from the applicator to the outlet, and/or facilitating lateral dispensing of the material upstream of the rear outlet.

A product may be produced by the aforementioned method(s). For example, a wing or a portion thereof may be produced by the aforementioned method(s).

This description, rather than describing limitations of an invention, only illustrates example embodiments of the invention recited in the claims. The language of this description is therefore exclusively descriptive and non-limiting. Obviously, it's possible to modify this invention from what the description teaches. Within the scope of the claims, one may practice the invention other than as described above.

What is claimed is:

1. A coating applicator comprising a liquid coating material reservoir configured to retain a liquid coating material via viscous retention and to dispense a liquid coating bead via surface adhesion, cohesion, and gravity;

side walls spaced laterally apart and having side bottom surfaces at least partially establishing a bottom opening of the liquid coating material reservoir in a first opening plane, the side walls including side bevel surfaces extending from side bottom surfaces and extending laterally and vertically between the side bottom and interior surfaces; and a rear wall coupled to and extending laterally between the side walls, the rear wall having a rear bottom surface spaced vertically away from the side bottom surfaces to establish a rear outlet in a second opening plane and in communication with the bottom opening.

2. The coating applicator of claim 1, wherein the rear wall also includes:

a rear exterior surface;

a rear interior surface spaced longitudinally from the rear exterior surface;

the rear bottom surface extending from the rear exterior surface, and extending longitudinally between the rear exterior and interior surfaces; and a rear bevel surface extending from the rear bottom surface, and extending longitudinally and vertically between the rear bottom and interior surfaces to promote gradual compression of material in a vertical direction as material is pulled out of the applicator toward a work surface through the rear outlet.

3. The coating applicator of claim 1 wherein the bottom surfaces of the side walls are longitudinally tapered, being wider in locations relatively distal with respect to the rear wall and being narrower in locations relatively proximate with respect to the rear wall.

4. The coating applicator of claim 3 wherein the tapered bottom surfaces establish an open taper angle of 5 to 15 degrees.

5. The coating applicator of claim 1, further comprising a front wall coupled to and extending laterally between the side walls, spaced longitudinally from the rear wall, and having a front bottom surface at least partially establishing the bottom opening in the first opening plane, wherein the walls establish a circumferentially complete reservoir to hold material for dispensing out of the rear outlet.

6. The coating applicator of claim 5, wherein the side walls include straight lower portions, outwardly tapered portions extending laterally outwardly and vertically from the straight lower portions, and straight upper portions extending vertically from the outwardly tapered portions, and wherein the front and rear walls are straight.

7. The coating applicator of claim 5, wherein the front wall has a bottom surface that, together with the bottom surfaces of the side walls, establish the first opening plane for the bottom opening, and all of the walls include upper surfaces that together establish an open top.

8. The coating applicator of claim 1, wherein no bottom wall connects the side walls and no wall extends longitudinally from the rear wall and laterally between the side walls over the rear outlet.

9. A coating applicator comprising:

a liquid coating material reservoir configured to retain a liquid coating material via viscous retention and to dispense a liquid coating bead via surface adhesion, cohesion, and gravity;

side walls spaced laterally apart and comprising side bottom surfaces at least partially establishing a bottom opening of the liquid coating material reservoir in a first opening plane, side exterior surfaces, side interior surfaces spaced laterally from the side exterior surfaces, and side bevel surfaces extending from side bottom surfaces and extending laterally and vertically between the side bottom and interior surfaces to further promote gradual squeezing of material;

a rear wall coupled to and extending laterally between the side walls and comprising a rear exterior surface, a rear interior surface spaced longitudinally from the rear exterior surface, a rear bottom surface spaced vertically away from the side bottom surfaces of the side walls to establish a rear outlet in a second opening plane and communication with the bottom opening;

the rear bottom surface of the rear wall extending from the rear exterior surface, and extending longitudinally between the rear exterior and interior surfaces; and the rear wall comprising a rear bevel surface extending from the rear bottom surface, and extending longitudinally and vertically between the rear bottom and interior surfaces.

10. The coating applicator of claim 9 wherein the rear and side bevel surfaces are part of a continuous bevel surface extending greater than ninety angular degrees among the rear and side walls.

11. The coating applicator of claim 9 wherein the rear and side bevel surfaces are filleted.

12. A coating applicator comprising a liquid coating material reservoir configured to retain a liquid coating material via viscous retention and to dispense a liquid coating bead via surface adhesion, cohesion, and gravity;

side walls spaced laterally apart and having side bottom surfaces at least partially establishing a bottom opening of the liquid coating material reservoir in a first opening plane, the side walls including side bevel surfaces extending from side bottom surfaces and extending laterally and vertically between the side bottom and interior surfaces; and a rear wall coupled to and extending laterally between the side walls has a rear bottom surface spaced vertically away from the side bottom surfaces to establish a rear outlet in a second opening plane and communication with the bottom opening; and lateral outlets in the rear and side walls, the lateral outlets being in communication with the bottom opening and disposed in lateral opening planes different from the other opening planes and including lateral outlet bottom surfaces spaced vertically from the rear bottom surface in a direction away from the side bottom surfaces.

13. The coating applicator of claim 12 wherein the lateral outlet bottom surfaces extend laterally between the side exterior surfaces and the rear and side bevel surfaces.

14. The coating applicator of claim 13 wherein the lateral outlets include tapered surfaces in the rear wall extending from the rear bottom surface to the lateral outlet bottom surfaces and being disposed at a non-zero angle with respect to a longitudinal axis of the coating applicator.

* * * * *